US010667591B2

(12) United States Patent
Burnet et al.

(10) Patent No.: US 10,667,591 B2
(45) Date of Patent: Jun. 2, 2020

(54) KNITTED HAIRNET

(71) Applicant: ABURNET LIMITED, Derbyshire (GB)

(72) Inventors: Richard John Stacey Burnet, Nottingham (GB); Keith Gordon Simpkin, Nottingham (GB)

(73) Assignee: Aburnet Limited, Derbyshire (GB)

( * ) Notice: Subject to any disclaimer, the term of this patent is extended or adjusted under 35 U.S.C. 154(b) by 0 days.

(21) Appl. No.: 14/394,646

(22) PCT Filed: Apr. 15, 2013

(86) PCT No.: PCT/GB2013/050961
§ 371 (c)(1),
(2) Date: Oct. 15, 2014

(87) PCT Pub. No.: WO2013/156762
PCT Pub. Date: Oct. 24, 2013

(65) Prior Publication Data

US 2015/0114426 A1 Apr. 30, 2015

(30) Foreign Application Priority Data

Apr. 16, 2012 (GB) ..... 1206641.1

(51) Int. Cl.
*A45D 8/40* (2006.01)
*A42B 1/04* (2006.01)
*D04B 21/10* (2006.01)

(52) U.S. Cl.
CPC ..... *A45D 8/40* (2013.01); *A42B 1/043* (2013.01); *D04B 21/10* (2013.01)

(58) Field of Classification Search
CPC ..... A41G 3/005; A41G 3/0016; A41G 5/00; A41G 5/004; A41G 3/0041; A41G 3/0075; A45D 8/40; A42B 1/043; A42B 1/10
USPC ..... 112/416, 430, 439
See application file for complete search history.

(56) References Cited

U.S. PATENT DOCUMENTS 1,187,158 A 6/1916 McGinley
1,201,803 A 10/1916 Chace
1,300,881 A * 4/1919 Saenger ..... A45D 8/40 132/274
1,661,141 A 2/1928 Lipper
2,104,538 A 1/1938 Goldsmith
(Continued)

FOREIGN PATENT DOCUMENTS

GB 534285 * 3/1941
GB 549196 A 11/1942
(Continued)

OTHER PUBLICATIONS

International Preliminary Report on Patentability, dated Oct. 21, 2014, from International Application No. PCT/GB2013/050961.
(Continued)

*Primary Examiner* — Rachel R Steitz
*Assistant Examiner* — Brianne Kalach
(74) *Attorney, Agent, or Firm* — Young Basile Hanlon & MacFarlane, P.C.

(57) ABSTRACT

A hairnet is formed of a knitted fabric with parallel lines of stitches connected by transverse threads. The density of threads in the parallel lines of stitches is greater than the density of the transverse threads.

20 Claims, 7 Drawing Sheets

(56) References Cited

U.S. PATENT DOCUMENTS

| | | | | | |
|---|---|---|---|---|---|
| 2,412,336 | A | * | 12/1946 | Hunter | A41G 3/005 87/4 |
| 2,524,255 | A | * | 10/1950 | Goldsmith | A45D 8/40 132/274 |
| 2,638,102 | A | | 5/1953 | Goldsmith | |
| 2,691,286 | A | | 10/1954 | Cooper | |
| 2,740,412 | A | * | 4/1956 | Mayer | A45D 8/40 132/274 |
| 2,742,910 | A | | 4/1956 | Berg | |
| 3,094,995 | A | * | 6/1963 | Dietze | A45D 8/40 132/274 |
| 3,118,294 | A | | 1/1964 | Van Laethem | |
| 6,116,058 | A | | 9/2000 | Diestel et al. | |
| 2003/0106347 | A1 | | 6/2003 | Kost | |
| 2011/0145976 | A1 | | 6/2011 | Osgood | |
| 2012/0132227 | A1 | | 5/2012 | Dietze | |

FOREIGN PATENT DOCUMENTS

| | | | | |
|---|---|---|---|---|
| GB | 581044 | | * | 7/1943 |
| GB | 565436 | A | | 11/1944 |
| WO | 2012119624 | A1 | | 9/2012 |

OTHER PUBLICATIONS

Third Party Observations dated Feb. 12, 2014, from Adrian Wright, Chief Operating Officer of the Nottingham Textile Group to the British Intellectual Property Office.

Appendix A and Appendix B to the Third Party Observations dated Feb. 12, 2014, from Adrian Wright, Chief Operating Officer of the Nottingham Textile Group to the British Intellectual Property Office.

Third Party Observations dated May 9, 2014, from Adrian P. Wright, Chief Operating Officer of the Nottingham Textile Group to the British Intellectual Property Office.

* cited by examiner

Prior Art

KNITTED HAIRNET

CROSS REFERENCE TO RELATED APPLICATION

The present application claims priority to Great Britain Patent Application No. 1206641.1, filed Apr. 16, 2012, incorporated herein in its entirety.

TECHNICAL FIELD

The present invention relates to hairnets. In particular, the present invention relates to hairnets for use as headwear for hygienic purposes in catering and retail establishments, factories and the like, and other establishments in which hygiene is of importance such as hospitals and other health service establishments.

BACKGROUND

In workplaces such as catering establishments and factories where foodstuffs are manufactured and/or packaged, or pharmaceutical or cosmetic manufacturing establishments, it is often a requirement that workers keep their hair covered at all times for reasons of hygiene. Headwear for use in such an environment must effectively cover the hair and prevent the loss of individual hairs that would otherwise contaminate the goods being produced.

Hairnets worn for this purpose are generally disposed of and replaced on a regular basis, and it is therefore important that such hairnets can be produced at low cost and in large numbers. As a workplace will generally stock large numbers of hairnets for use by the workforce, it is also preferable that one size of hairnet provides a suitable fit for all users, eliminating the need to store multiple sizes of hairnet.

A range of hairnets are commonly used in the workplace. Conventionally, such hairnets are made from a nylon, polyester, or polypropylene mesh. Hairnets are commonly woven on conventional net looms, or knitted, most usually by forming a continuous band of fabric, individual hairnets being produced by crimping the fabric at two points (cinch points) corresponding to the front and back of the hairnet and cutting the hairnet so formed from the continuous band of fabric.

The open mesh structure of conventional hairnets is desirable as it is cool and non-restrictive for the user to wear, but it also has a number of disadvantages. During normal use, for instance if the wearer scratches their head or if the hairnet is stretched or its position adjusted, the user's hair will move against the hairnet, and some individual hairs may be pushed through the mesh, which can result in hairs being lost and the work area becoming contaminated with hair and hence becoming unhygienic or the product being contaminated or damaged, such when hairs are incorporated into a coating formed by paint spraying of, for instance, a car. In addition, the mesh structure means that conventional hairnets have limited elasticity and hence do not conform easily to the user's head. Ill-fitting headwear is likely to be more uncomfortable for the user, reducing compliance by workers with regulations governing the use of hairnets. Ill-fitting hairnets may also be less effective in retaining the hair. One solution to the problem of hair protruding through hairnets has been the provision of headwear made of solid fabric through which the hair cannot penetrate. However, such headwear can be hot and uncomfortable for the user to wear, restricting the head and, particularly if the user has a long or full hairstyle, not effectively containing the hair.

SUMMARY

There has now been devised an improved hairnet which overcomes or substantially mitigates the above-mentioned and/or other problems associated with the prior art.

According to a first aspect of the invention there is provided a hairnet formed of a knitted fabric, the knitted fabric comprising parallel lines of stitches connected by transverse threads, wherein the density of threads in said parallel lines of stitches is greater than the density of said transverse threads.

It has been found that the use knitted fabric having the above described structure to produce hairnets results in hairnets wherein, in use, significantly less or none of the user's hair protrudes through the hairnet in comparison to conventional hairnets. It is believed that the transverse threads have the effect of combing back the user's hair, thus holding the hair against the user's head and reducing or eliminating the tendency of hair to protrude through the hairnet. This prevents the user's work area from becoming contaminated with hair, and hence helps to maintain high levels of hygiene in the workplace.

Knitted fabrics, due to their structure, generally have a higher degree of elasticity than woven or other nonwoven fabrics. In particular, the knitted fabric used in hairnets of the present invention has a very high degree of elasticity in all directions. This is advantageous as it enables the hairnet to stretch to an appropriate size and shape to snugly fit the user's head, thus enabling a single size of hairnet to be worn by all users, as well as effectively containing the user's hair regardless of head size or hairstyle. The knitted structure of hairnets according to the present invention provides for particularly beneficial elasticity in the transverse direction. The separation of the parallel lines of stitches may easily be increased, by stretching the fabric in that direction, the parallel lines of stiches being drawn back towards each by the transverse threads when the stretching force is removed. This enables the hairnet to stretch to fit the user's head, and to subsequently contract to its original size. This enables hairnets produced according to the present invention to be easily reused, thereby reducing wastage.

The knitted fabric from which the hairnet is produced may be made using any conventional method known to those skilled in the art. For example, the knitted fabric may be produced using a flat bed knitting machine, such as a Raschel knitting machine. Merely as an illustration of the method by which the knitted fabric may be produced, the parallel lines of stitches may be formed from a one needle warp thread. Alternatively, the parallel lines of stitches may be formed from multiple overlaying and/or interlocking one needle warp threads, eg two warp threads, three warp threads or four warp threads. The transverse threads may be formed from, for example, a two needle warp thread, or a three needle warp thread. Alternatively, the transverse threads may be formed from multiple overlaying and/or interlocking two needle warp threads or three needle warp threads.

An expandable mesh fabric structure can be achieved without the use of expensive stretch yarns, thereby reducing the cost for a disposable product. The structure may comprise thicker parallel lines of stitches linked at intervals by transverse threads that are diagonally crossed. This provides a flexible structure that will comb hairs flat and expand widthways sufficiently to accommodate the individual's head and hair, thereby holding the hair in place far better than a conventional net that neither combs the hair flat nor expands to fit the wearer's head and hair to the same extent.

The fabric construction may be achieved by using two full set bars of yarn, knitting over two needles in opposition to create the lateral flexibility. Both closed and open loop structures and variable patterning techniques can be used to effect greater lateral stretch using non-stretch yarns.

Methods for producing hairnets from appropriate fabric are known in the art, and any suitable method may be used to produce hairnets according to the present invention. For example, hairnets according to the invention may be produced with two cinch points (commonly situated at the front and back of the user's head) or with one cinch point (commonly situated at the back of the user's head).

Hairnets according to the invention may be produced from synthetic or natural materials. Preferably, hairnets according to the invention are made from synthetic fibres such as nylon, polyester, viscose, acrylic or polypropylene. More preferably, the synthetic fibres are nylon, polyester or polypropylene. Natural fibres such as cotton may also be used.

Hairnets according to the invention may be used in any environment in which it is generally desirable to wear a hairnet. In particular, hairnets according to the invention may be used in environments in which it is important to maintain a high level of hygiene. For example, hairnets according to the invention may be used in catering establishments and factories where foodstuffs are manufactured and/or packaged, or pharmaceutical or cosmetic manufacturing establishments, or medical establishments. The hairnets may also be used in industrial situations in which avoidance of contamination by hair is critical, e.g., in paint spraying processes.

Hairnets according to the invention are typically designed to be worn such that the parallel lines of stitches run from the front of the user's head to the back. Wearing the hairnet in this manner enables the transverse threads to effectively comb back hairs on the user's head both when the user is putting on the hairnet, and whilst it is being worn. This action keeps hairs close to the user's head, thus preventing them from poking through the hairnet and contaminating the work area. To enhance this effect, the hairnet is preferably applied to the user's head by the user first inserting their hands into the hairnet and moving them apart to stretch the hairnet in the transverse direction, just enough to enable the hairnet to be fitted over the wearer's hair, and then applying the stretched hairnet to the head from front to back, so that the transverse threads are drawn backwards over the hair, and cause the hairs to be pressed down with a sort of combing action. In certain embodiments, however, it may alternatively be desirable to apply the hairnet from one side to the other.

A hairnet according to the invention may be secured to the user's head using any appropriate means. For example, the hairnet may be elasticated around the edge of the hairnet, and/or may comprise ties which enable the user to secure the hairnet to their head. Preferably, the edge of the hairnet is elasticated by, for example, incorporating elastic threads into the knitted fabric, or by weaving elastic threads into the finished hairnet.

Hairnets according to the invention may be produced by knitting a continuous length of knitted fabric which is then separated into individual hairnets by binding the knitted fabric together at intervals (commonly referred to as cinch points) and cutting the fabric in the bound regions. Binding of the knitted fabric may, for instance, be accomplished by knotting of the fabric, by fusing the material of the fabric through the application of heat and/or pressure, or by the application to the fabric of metal staples or other forms of clips that crimp the fabric together. By way of example, pairs of metal staples may be applied to form each bound region, with a small separation between the staples of each, the fabric subsequently being cut between the staples to form the individual hairnets. Clearly, the separation of the pairs of staples (or other means of binding the fabric) is chosen to correspond to the desired size of the finished hairnet.

Thus, according to another aspect of the invention, there is provided a method of producing a hairnet of the form described above, which method comprises the steps of a) knitting a continuous length of knitted fabric comprising parallel lines of stitches connected by transverse threads, wherein the density of threads in said parallel lines of stitches is greater than the density of said transverse threads;

b) binding the knitted fabric together at intervals; and c) cutting the fabric at the bound regions to form individual hairnets.

For the manufacture of a simple hairnet, most commonly one or more elastic yarns or cords are incorporated into the structure of the knitted fabric, close to the edges of the continuous length of fabric. In such an arrangement, the parallel lines of stitches may extend parallel to the longitudinal axis of the fabric, in which case (because the hairnet would usually be worn with the parallel lines of stitches extending from front to back of the wearer's head, as explained above) the bound regions would normally constitute the front and back of the hairnet.

The invention may also be embodied, however, in a more complex structure in which the first part of the hairnet that fits over the wearer's head is formed integrally with a second part that lies, in use, over the back of the wearer's neck to accommodate long hair. Such a structure may be achieved by incorporating elastic yarns or cords at one edge of the fabric and at a position intermediate the edges of the fabric, the part of the fabric between those elastic yarns or cords constituting the first part of the hairnet (that fits over the wearer's head), and the rest being the second part that covers the long hair. The other edge of the fabric may also be elasticated, and the position of the intermediate elastication is chosen according to the relative sizes of the first and second parts of the finished product.

Hairnets having the form just described are believed to be novel and represent a further aspect of the present invention, which therefore provides a hairnet comprising a first part that fits over the wearer's head and a second part that is formed integrally with the first part and lies, in use, over the back of the wearer's neck to accommodate long hair, the first and second parts being constituted by a length of fabric that is bound together at its ends to form cinch points and which is elasticated at or adjacent a first longitudinal edge thereof and at a position intermediate the longitudinal edges of the fabric, the part of the fabric between the first longitudinal edge and the intermediate elastication constituting the first part of the hairnet, and the rest of the fabric constituting the second part of the hairnet.

A related aspect of the invention provides a method of producing a hairnet of the type just described, which method comprises a) knitting a continuous length of knitted fabric which is elasticated at or adjacent a first longitudinal edge thereof and at a position intermediate the longitudinal edges of the fabric;

b) binding the knitted fabric together at intervals; and c) cutting the fabric at the bound regions to form individual hairnets.

In currently preferred embodiments, the second longitudinal edge of the fabric is also elasticated.

In the sort of structure just described, because the hairnet will generally be worn with the second part at the back, the bound regions (cinch points) will be at the sides of the wearer's head.

The fabric used in the manufacture of such a hairnet may be of the type used in the hairnet of the first aspect of the invention, i.e., a fabric comprising parallel lines of stitches connected by transverse threads, wherein the density of threads in said parallel lines of stitches is greater than the density of said transverse threads. The fabric may, however, have other forms, including a conventional knitted structure in which the structure is essentially uniform in both longitudinal and transverse directions.

Where the fabric does comprise parallel lines of stitches connected by transverse threads, and where, as is most common, the parallel lines of stitches extend parallel to the longitudinal axis of the fabric from which the hairnet is formed, because of the positions of the cinch points on the wearer's head the parallel lines of stitches will extend, in use, from one side of the wearer's head to the other, rather than from front to back. To achieve the combing effect of the transverse threads described above, it may therefore be desirable for such a hairnet to be applied to the head from the sides, rather than from front to back.

It may also be possible to produce a fabric in which the parallel lines of stitches extend across, rather than parallel to, the longitudinal axis of the fabric, in which case the parallel lines of stitches in the complex hairnet just described will, in use, be oriented from the front of the wearer's head to the back, as for the simple hairnet structure according to the first aspect of the invention.

It should be understood that the term "hairnet" as used herein is intended to encompass all items of headgear worn in the manner of a conventional hairnet. Such items will most commonly have a relatively open, net- or mesh-like structure, but may in certain embodiments have a close-knit, denser and less open structure, in which case they may alternatively be described as "caps" or "bonnets".

BRIEF DESCRIPTION OF THE DRAWINGS

Embodiments of the invention will now be described in more detail, by way of illustration only, with reference to the following drawings.

DETAILED DESCRIPTION OF THE EMBODIMENTS

Figure 1:
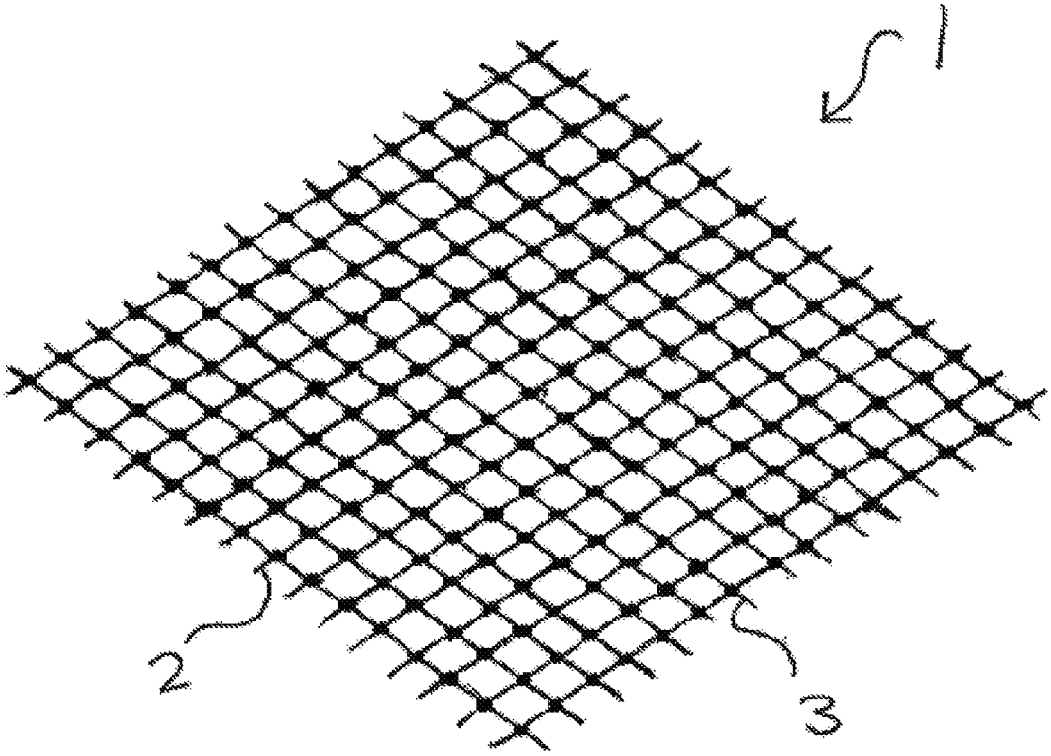
FIG. 1 is a fragmentary view that shows the structure of a knitted fabric used in the manufacture of a conventional hairnet, in a stretched configuration as when the hairnet is worn.

Referring first to FIG. 1, a conventional hairnet is produced from fabric 1 having the structure shown. The fabric 1 has an open mesh structure that is essentially the same, whether viewed along the stitching line labelled 2 or along the transverse stitching line labelled 3.

Figure 2:
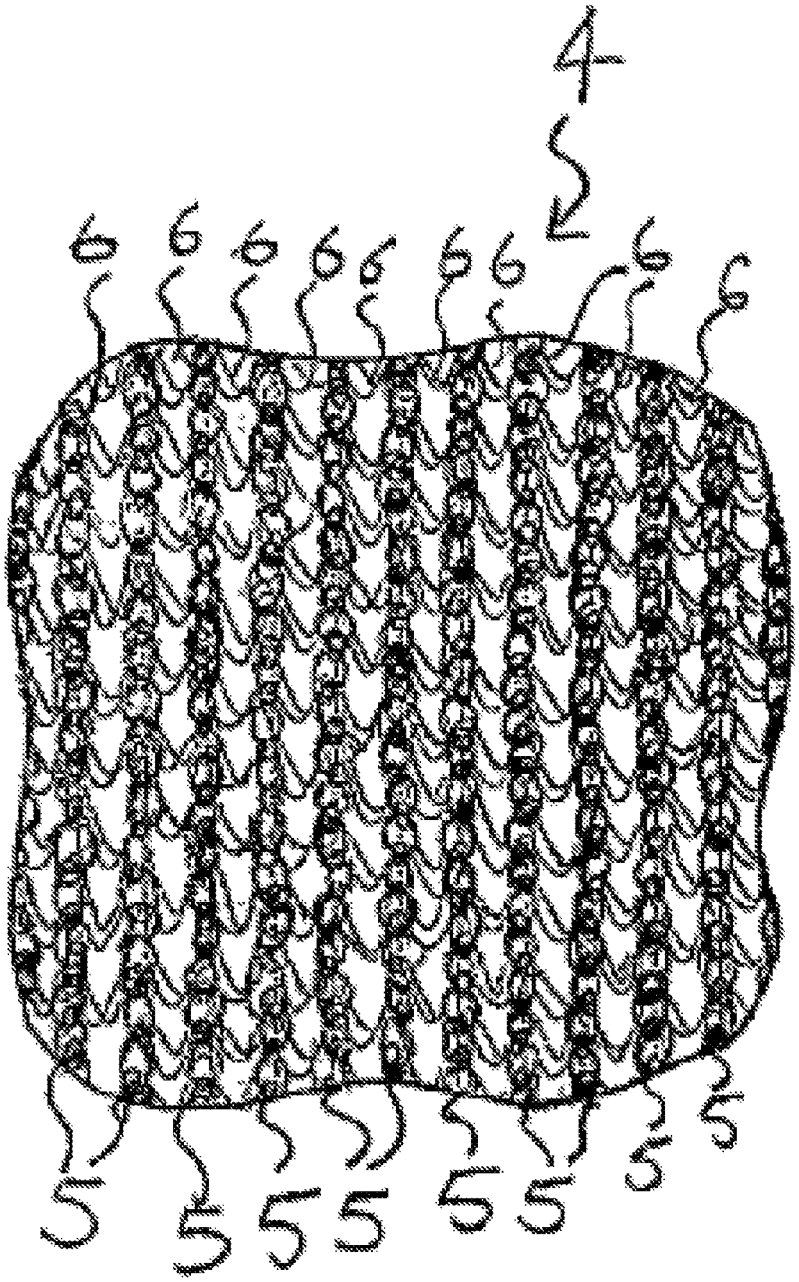
FIG. 2 is a view similar to FIG. 1 that shows the structure of a knitted fabric used in the manufacture of a hairnet according to the invention, in a relaxed configuration.
Figure 3:
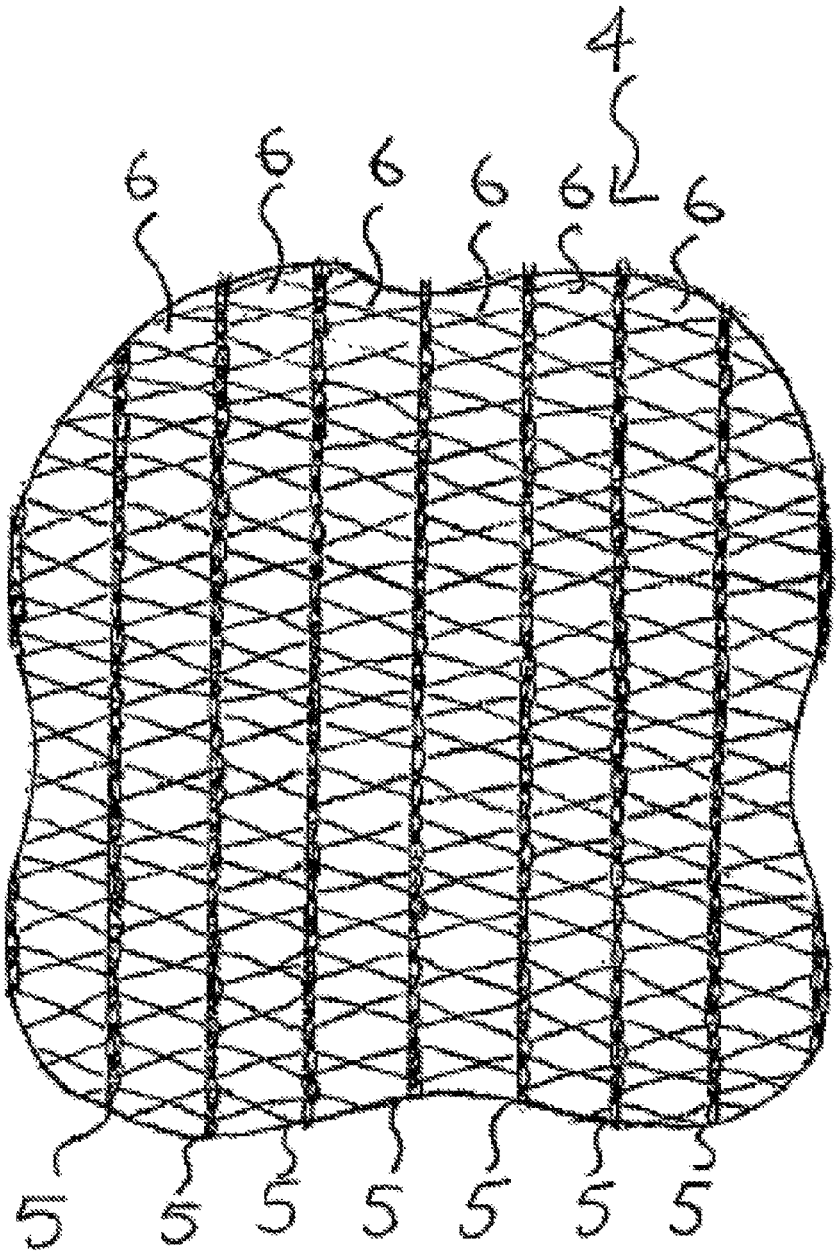
FIG. 3 shows the structure of the fabric of FIG. 2 in a stretched configuration, as when the hairnet is worn.

Hairnets of the present invention are produced from knitted fabric 4 having the structure shown in FIGS. 2 and 3. The knitted fabric 4 comprises parallel lines of stitches 5, which are connected by a series of transverse threads 6. The transverse threads 6 between each set of parallel lines 5 are in pairs such that, when the fabric 4 is stretched (FIG. 3), the transverse threads 6 of each pair cross in an "x"-configuration between the parallel lines of stitches 5.

The fabric 4 can be changed from the configuration shown in FIG. 2 to that of FIG. 3 by placing the fabric 4 under tension, such as happens when the hairnet is stretched by a user along the transverse direction prior to application to the user's head. Once the hairnet has been applied to the head, the tension is released, and the fabric 4 returns partially to the configuration shown in FIG. 2, ensuring a close fit to the user's head. When the hairnet is removed from the head, the fabric 4 returns completely to the relaxed configuration of FIG. 2. This relaxation may be aided by stretching the fabric 4 along the parallel lines of stitches 5, causing the transverse threads 6 to return towards their original, unstretched position.

Without wishing to be bound by theory, it is believed that when the fabric 4 is placed under tension by being stretched in the transverse direction, yarn is pulled from the parallel lines of stitches 5 and into the transverse threads 6. When the fabric 4 is stretched along the parallel lines of stitches 5, yarn is pulled from the transverse threads 6 and back into the parallel lines of stitches 5. This transfer of yarn between the parallel lines of stitches and the transverse threads enables the fabric 4 to stretch significantly, without the need for elastic yarns.

Figure 4:
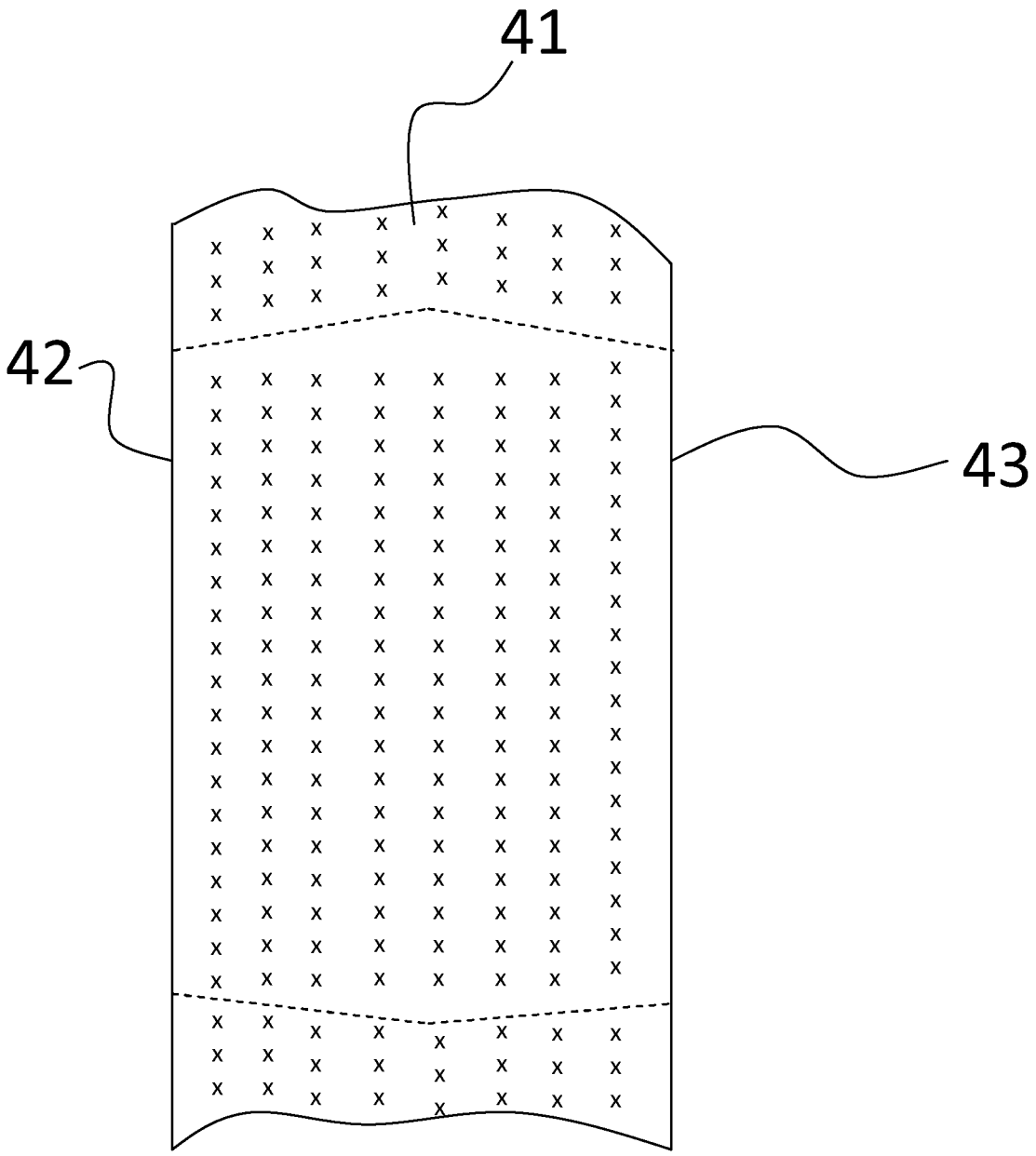
FIG. 4 is a schematic view of a continuous length of fabric used in the manufacture of a hairnet according to the invention.

Referring now to FIG. 4, a first embodiment of a hairnet according to the invention is manufactured by knitting a continuous band of fabric 41. The fabric 41 incorporates elastic cords or yarns 42, 43 at (or close to) its edges. In FIG. 4, the lines xxxxxxx represent the parallel lines of stitches denoted 5 in FIGS. 2 and 3. FIG. 4 is of course schematic and the number of such lines of stitches is in reality much greater than that depicted.

Figure 5:
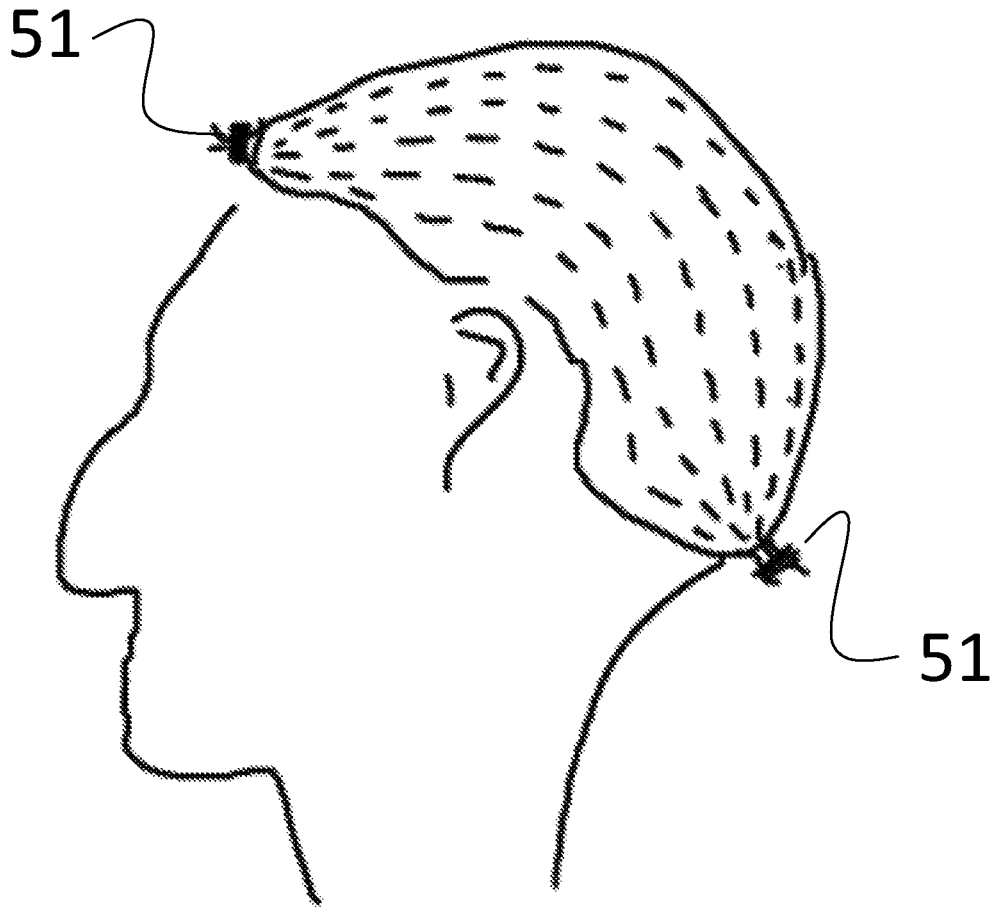
FIG. 5 shows the manner in which a hairnet produced from the fabric of FIG. 4 is worn.

The band of fabric 41 is bound together at intervals represented by the broken lines. This may be achieved by squeezing the fabric together at those points and applying pairs of metal staples 51 (shown in FIG. 5), and then cutting the fabric 41 in the space between the staples 51 of each pair to form individual hairnets. The manner in which such a hairnet is worn is shown schematically in FIG. 5. As can be seen, the hairnet is worn with the regions bound by the staples 51 at the front and back, so that the parallel lines of stitching (represented schematically by the broken lines in FIG. 5) extend from the front to the back of the wearer's head.

Figure 6:
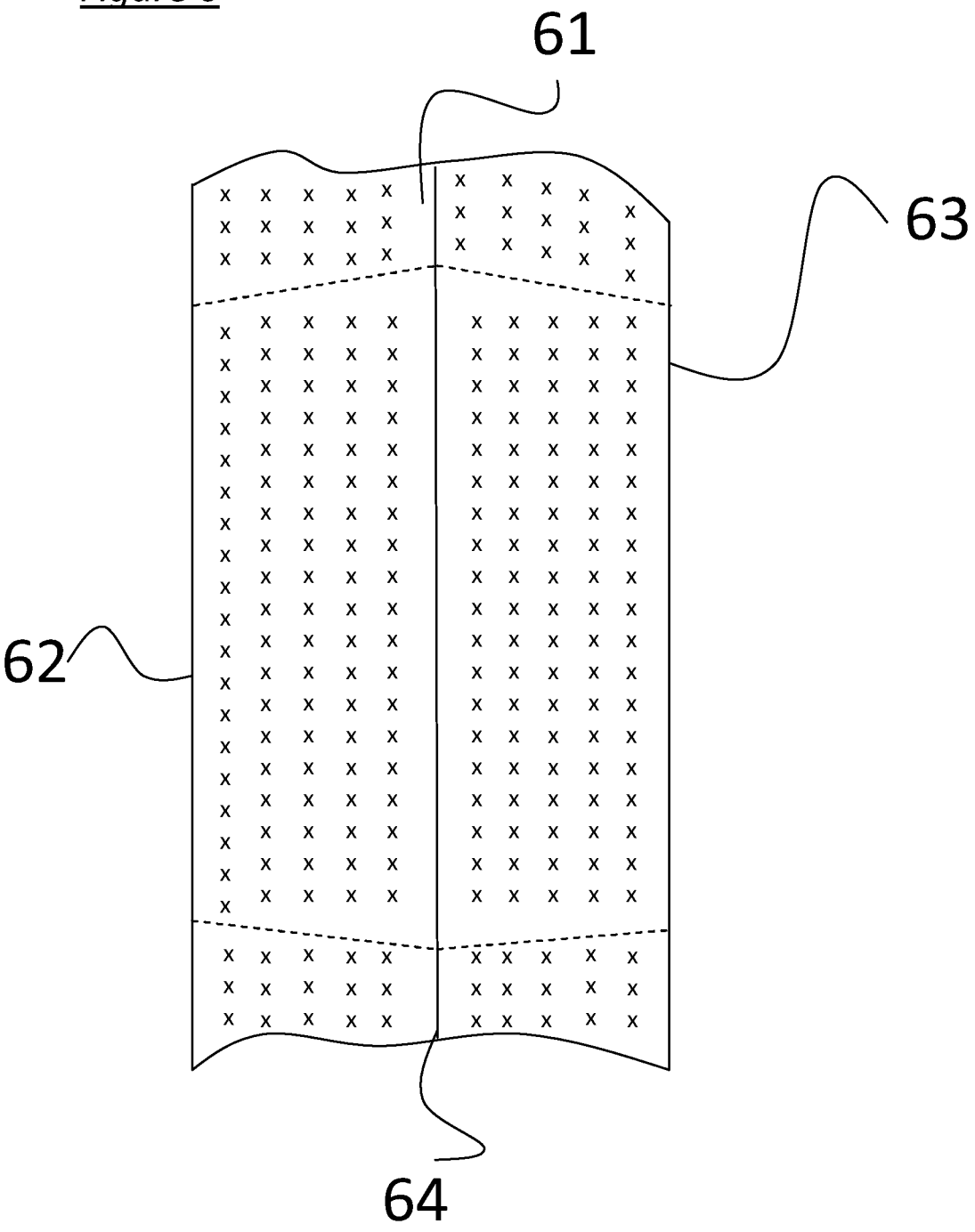
FIG. 6 shows a view similar to FIG. 4 of a continuous length of fabric used in the manufacture of a hairnet including a depending portion to accommodate long hair over the wearer's neck.
Figure 7:
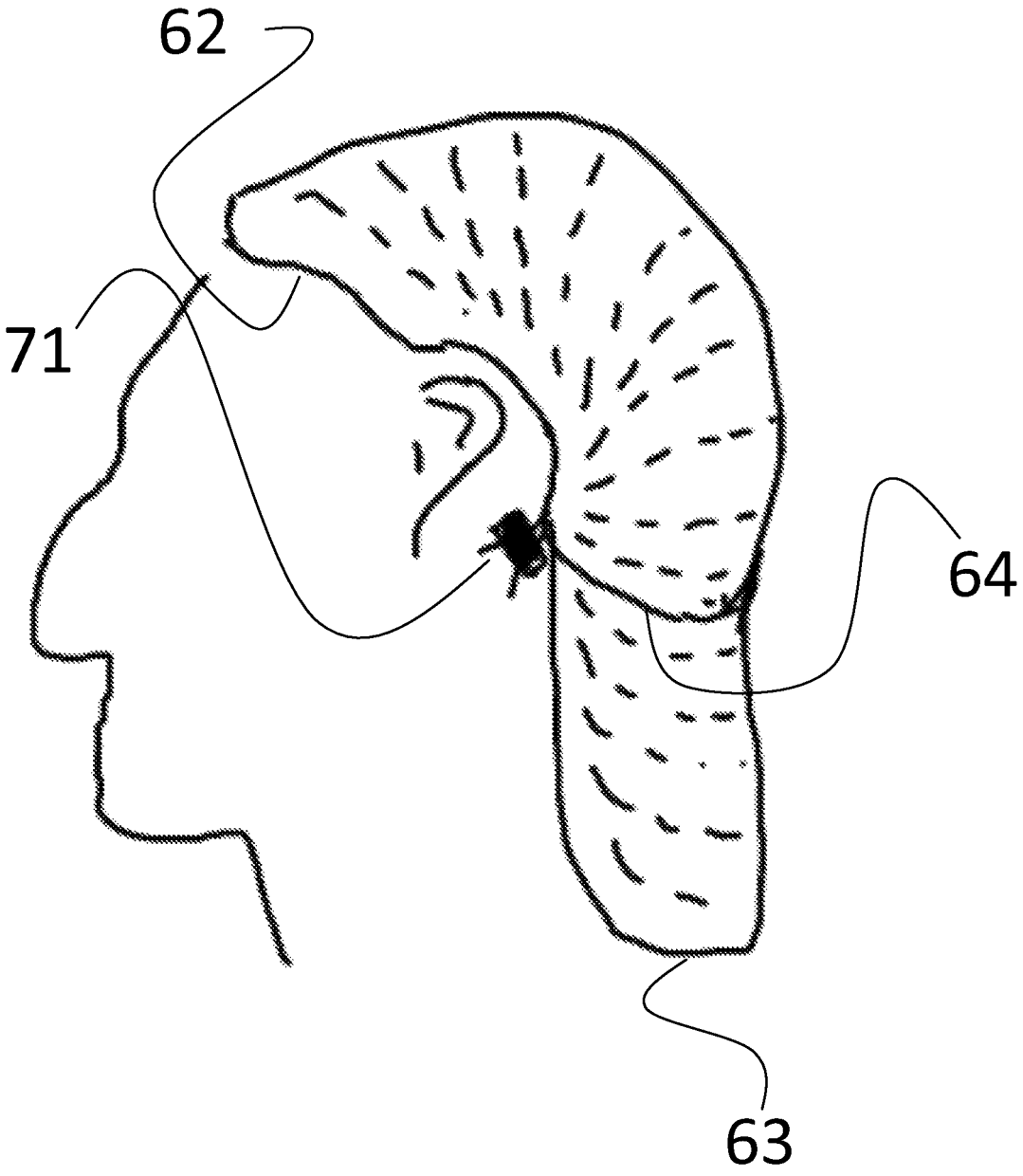
FIG. 7 shows the manner in which a hairnet produced from the fabric of FIG. 6 is worn.

Turning now to FIG. 6, another form of hairnet is produced from a continuous band of fabric 61 that, in this instance, has elastic yarns or cords not only at its edges 62, 63, but also extending longitudinally at an intermediate position 64. The parallel lines of stitches (represented schematically by the lines xxxxxx) again extend parallel to the longitudinal axis of the fabric 61. When formed into individual hairnets (in the same manner as the embodiment of FIGS. 4 and 5, by applying pairs of metal staples at the positions indicated by the broken lines in FIG. 6, and cutting between the staples of each pair), one side of the fabric 61 forms a hairnet that is worn over the wearer's head, while the other side of the fabric 61 forms a pouch that accommodates long hair over the back of the wearer's neck. This is illustrated in FIG. 7, from which it can be seen that the staples 71 in this embodiment occur at the sides rather than at the front and back of the wearer's head, and that the parallel lines of stitches extend, in use, across the wearer's head from one side to the other, rather than from front to back.

In other embodiments, the elastication at the edge 63 of the fabric 61 may be omitted, in which case the edge of the pouch that lies at the back of the wearer's neck is not elasticated. This has the result that the pouch may hang rather lower over the wearer's neck.

The invention claimed is:

1. A hairnet formed of a knitted fabric, the knitted fabric comprising an expandable mesh fabric structure formed of parallel lines of stitches connected by pairs of transverse threads, each of the pairs of transverse threads having a first transverse thread and a second transverse thread each running transversely from a first parallel line of stitches of two adjacent parallel lines of stitches to a second parallel line of stitches of the two adjacent parallel lines of stitches, and each running transversely between only the two adjacent parallel lines of stitches with the first transverse thread crossing the second transverse thread between the two adjacent parallel lines of stitches at regular intervals along a length of the two adjacent parallel lines of stitches, the length extending between first and second ends of the two adjacent parallel lines of stitches, the first and second ends of the two adjacent parallel lines of stitches being positioned at opposing edges of the hairnet, and, on stretching the hairnet along a transverse direction, a separation between the two adjacent parallel lines of stitches is increased and the first transverse thread and the second transverse thread of each of the pairs cross in an "x"-configuration between the two adjacent parallel lines of stitches and, when the stretching force is removed, the two adjacent parallel lines of stitches are drawn back towards each other by the pairs of transverse threads ensuring a close fit to a user's head, and wherein a density of threads in said parallel lines of stitches is greater than a density of threads in said transverse threads.

2. The hairnet according to claim 1, wherein the parallel lines of stitches are formed from one or more one needle warp threads.

3. The hairnet according to claim 1, wherein the transverse threads are formed from one or more two needle warp threads.

4. The hairnet according to claim 1, wherein the transverse threads are formed from one or more three needle warp threads.

5. The hairnet according to claim 1, which has two cinch points.

6. The hairnet according to claim 1, which has one cinch point.

7. The hairnet according to claim 1, which is made from synthetic fibers.

8. The hairnet according to claim 7, wherein the synthetic fibers are polyester, nylon, viscose or polypropylene.

9. The hairnet according to claim 1, which is made from natural fibers.

10. The hairnet according to claim 9, wherein the natural fibers are cotton.

11. The hairnet according to claim 1 wherein, in use, the parallel lines of stitches run from a front of a user's head to a back.

12. The hairnet according to claim 1, wherein an edge of the hairnet is elasticated.

13. The hairnet according to claim 1, which comprises a first part that fits over a wearer's head and a second part that lies, in use, over a back of a wearer's neck to accommodate long hair.

14. The hairnet according to claim 1, wherein the parallel lines of stitches are bound together at at least one end, and the hairnet further comprises at least one elastic cord or yarn at or close to its edges.

15. The hairnet according to claim 1, wherein the expandable mesh fabric structure comprises more than eight parallel lines of stitches connected by transverse threads, and the parallel lines of stitches are bound together at at least one end.

16. A method of producing hairnets as claimed in claim 1, which method comprises the steps of:

a) knitting a continuous length of knitted fabric comprising parallel lines of stitches connected by pairs of transverse threads that are diagonally crossed, wherein a density of threads in said parallel lines of stitches is greater than a density of the threads in said transverse threads;

b) binding the knitted fabric together at intervals; and c) cutting the knitted fabric at bound regions to form individual hairnets.

17. A hairnet comprising:

a first part that fits over a wearer's head; and a second part that is formed integrally with the first part and lies, in use, over a back of a wearer's neck to accommodate long hair, the first and second parts being constituted by a length of fabric that is bound together at its ends to form cinch points and which is elasticated at or adjacent a first longitudinal edge thereof and at a position intermediate longitudinal edges of the fabric, a part of the fabric between the first longitudinal edge and an intermediate elastication constituting the first part of the hairnet, and a rest of the fabric constituting the second part of the hairnet, wherein the fabric being knitted comprises an expandable mesh fabric formed of parallel lines of stitches connected by pairs of transverse threads, each of the pairs of transverse threads having a first transverse thread and a second transverse thread each running transversely from a first parallel line of stitches of two adjacent parallel lines of stitches to a second parallel line of stitches of the two adjacent parallel lines of stitches, and each running transversely between only the two adjacent parallel lines of stitches with the first transverse thread crossing the second transverse thread between the two adjacent parallel lines of stitches at regular intervals along a length of the two adjacent parallel lines of stitches, the length extending between first and second ends of the two adjacent parallel lines of stitches, the first and second ends of the two adjacent parallel lines of stitches being positioned at opposing edges of the hairnet, and, on stretching the hairnet along a transverse direction, a separation between the two adjacent parallel lines of stitches is increased and the first transverse thread and the second transverse thread of each of the pairs cross in an "x"-configuration between the two adjacent parallel lines of stitches and, when the stretching force is removed, the two adjacent parallel lines of stitches are drawn back towards each other by the pairs of transverse threads ensuring a close fit to the wearer's head, and wherein a density of threads in said parallel lines of stitches is greater than a density of threads in said transverse threads.

18. A method of producing hairnets as claimed in claim 17, which method comprises:

a) knitting a continuous length of knitted fabric which is elasticated at or adjacent a first longitudinal edge thereof and at a position intermediate longitudinal edges of the knitted fabric, the knitted fabric comprising parallel lines of stitches connected by pairs of transverse threads that are diagonally crossed, wherein a density of threads in said parallel lines of stitches is greater than a density of the threads in said transverse threads;

b) binding the knitted fabric together at intervals; and c) cutting the knitted fabric at bound regions to form individual hairnets.

19. The method as claimed in claim 18, wherein a second longitudinal edge of the fabric is also elasticated.

20. The hairnet as claimed in claim 17, wherein a second longitudinal edge of the fabric is also elasticated.

* * * * *